US009255356B2

(12) United States Patent
Cheon et al.

(10) Patent No.: US 9,255,356 B2
(45) Date of Patent: Feb. 9, 2016

(54) SUPPORTING DEVICE AND WASHING MACHINE HAVING THE SAME

(75) Inventors: Young Seong Cheon, Suwon-si (KR); Byoung Mock Kahm, Suwon-si (KR); Young Kook Ki, Suwon-si (KR); Jong Hun Sung, Suwon-si (KR); Sung Hwan Kim, Daejeon (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 329 days.

(21) Appl. No.: 12/923,122

(22) Filed: Sep. 2, 2010

(65) Prior Publication Data

US 2011/0084581 A1 Apr. 14, 2011

(30) Foreign Application Priority Data

Oct. 13, 2009 (KR) ..... 10-2009-97457

(51) Int. Cl.

| | |
|---|---|
| ***A47B 77/06*** | (2006.01) |
| ***D06F 39/12*** | (2006.01) |
| ***A47B 91/02*** | (2006.01) |

(52) U.S. Cl.

CPC ..... *D06F 39/125* (2013.01); *A47B 91/024* (2013.01)

(58) Field of Classification Search

CPC ..... D06F 39/125
USPC ..... 312/228, 351.1, 351.3, 351.2; 248/673, 248/677, 188.8, 188.91, 346.07, 678, 680, 248/681

See application file for complete search history.

(56) References Cited

U.S. PATENT DOCUMENTS

| | | | | |
|---|---|---|---|---|
| 4,138,079 | A * | 2/1979 | Ehret et al. | 248/558 |
| 5,172,885 | A * | 12/1992 | Kreischer | 248/539 |
| 5,653,416 | A | 8/1997 | Frank | |
| 5,699,993 | A * | 12/1997 | Hill et al. | 248/680 |
| 6,409,129 | B1 * | 6/2002 | Chen et al. | 248/188.8 |
| 6,427,966 | B1 * | 8/2002 | Blumenschein | 248/678 |
| 7,921,679 | B2 * | 4/2011 | Jo | 68/3 R |
| 2005/0275325 | A1 * | 12/2005 | Yang | 312/330.1 |
| 2006/0103281 | A1 * | 5/2006 | Cho | 312/351.2 |
| 2010/0201236 | A1 * | 8/2010 | Kim | 312/228 |

FOREIGN PATENT DOCUMENTS

| | | |
|---|---|---|
| CN | 101381948 A | 3/2009 |
| DE | 3213420 | 10/1983 |
| DE | 29710601 | 8/1997 |

(Continued)

OTHER PUBLICATIONS

European Search Report dated Oct. 14, 2010, issued in European Patent Application No. 10174244.3.

(Continued)

*Primary Examiner* — Daniel J Troy
*Assistant Examiner* — Andres F Gallego
(74) *Attorney, Agent, or Firm* — Staas & Halsey LLP

(57) ABSTRACT

A supporting device having improved assembly efficiency used to commonly support a washing machine and a drying machine with legs having different sizes, and a washing machine having the same. The supporting device includes a supporting device main body to support a washing machine main body, and supporters installed on the supporting device main body to receive and fix legs connected to the bottom of the washing machine main body, and each supporter includes a guide member to receive each leg, and at least one fixing member to fix each leg.

11 Claims, 12 Drawing Sheets

(56) References Cited

FOREIGN PATENT DOCUMENTS

| | | |
|---|---|---|
| DE | 19838631 | 3/2000 |
| EP | 1895041 | 3/2008 |
| KR | 1999-0028235 | 7/1999 |
| KR | 10-2004-0053623 | 6/2004 |
| KR | 10-2004-0085516 | 10/2004 |
| KR | 10-2004-0086059 | 10/2004 |
| KR | 10-0776601 | 11/2007 |
| KR | 10-2008-0032362 | 4/2008 |
| WO | 2008/075829 | 6/2008 |

OTHER PUBLICATIONS

Chinese Office Action issued on Jan. 10, 2014 in corresponding Chinese Application No. 201010502355.2.

Korean Office Action issued on Jan. 18, 2014 in corresponding Korean Application No. 10-2009-0097457.

Korean Office Action issued on Jan. 18, 2014 in corresponding Korean Application No. 10-2009-097457.

Chinese Office Action issued Jan. 13, 2015 in corresponding Chinese Patent Application No. 201010502355.2.

* cited by examiner

SUPPORTING DEVICE AND WASHING MACHINE HAVING THE SAME

CROSS-REFERENCE TO RELATED APPLICATIONS

This application claims the benefit of Korean Patent Application No. 2009-0097457, filed on Oct. 13, 2009 in the Korean Intellectual Property Office, the disclosure of which is incorporated herein by reference.

BACKGROUND

1. Field

Embodiments relate to a supporting device and a washing machine having the same.

2. Description of the Related Art

In general, washing machines are apparatuses which wash laundry by rotating a cylindrical spin basket containing the laundry and wash water. These washing machines are divided into a drum washing machine which washes laundry by raising and dropping laundry along the inner circumferential surface of a spin basket horizontally disposed when the spin basket is rotated in regular and reverse directions around a horizontal axis, and a vertical axis washing machine which washes laundry using a water current generated by a pulsator when a spin basket provided with the pulsator vertically disposed therein is rotated in regular and reverse directions around a vertical axis.

In a drum washing machine, a spin basket (hereinafter, referred to as a drum) is horizontally disposed and an inlet is formed through a front surface of a washing machine main body, and in a vertical axis washing machine, an inlet is formed through an upper surface of a washing machine main body, thereby allowing laundry to be put into and taken out of the washing machine main body. Particularly, in the drum washing machine when a user puts or takes laundry into and out of the main body of the washing machine main body through the inlet, the user bends over and experiences discomfort, and thus a supporting device to fix the washing machine main body to a designated height is recently used.

Now, a general process of connecting the supporting device to the washing machine main body will be described. First, the washing machine main body is laid down, and then legs connected to the bottom of the washing machine main body are separated from the washing machine main body, and the upper surface of the supporting device is attached to the bottom of the washing machine main body. Thereafter, a front surface and a rear surface are disassembled from the supporting device so as to put assembly tools into the supporting device, and the separated legs are connected to holes formed through the upper surface of the supporting device from the inside of the supporting device, thereby fixing the washing machine main body to the supporting device. Finally, the assembly of the washing machine main body and the supporting device is placed upright. Thereby, the connecting process is completed.

SUMMARY

Therefore, it is an aspect to provide a supporting device having improved assembly efficiency, and a washing machine having the same.

It is another aspect to provide a supporting device which is used in common to support a washing machine and a drying machine with legs having different sizes, and a washing machine having the same.

Additional aspects will be set forth in part in the description which follows and, in part, will be apparent from the description, or may be learned by practice of the invention.

In accordance with one aspect, a washing machine includes a washing machine main body, a supporting device main body to support the washing machine main body, a plurality of legs connected to the bottom of the washing machine main body, and supporters installed on the supporting device main body, wherein each supporter includes a guide member to receive each leg, and at least one fixing member to fix each leg.

The guide member may include at least one reception part to receive each leg of the washing machine main body.

The at least one fixing member may include at least one leg hole.

A plurality of fixing members may be provided, and the plurality of fixing members may be connected to each other to form the at least one leg hole.

The at least one leg hole may include a plurality of leg holes having different sizes.

The plurality of leg holes may be connected with each other.

The guide member may further include at least one connection hole to connect the supporting device main body and each supporter.

The guide member may further include position determination pins provided on the bottom surface of the guide member to determine a fixed position of each supporter on the supporting device main body.

The guide member may further include a rib provided on the bottom surface of the guide member to reinforce the supporter.

In accordance with a further aspect, a supporting device includes a supporting device main body to support a washing machine main body, and supporters installed on the supporting device main body to receive and fix legs connected to the bottom of the washing machine main body, wherein each supporter includes a guide member to receive each leg, and at least one fixing member to fix each leg.

The guide member may include at least one reception part to receive each leg of the washing machine main body, and the at least one fixing member may include at least one leg hole.

A plurality of fixing members may be provided, and the plurality of fixing members may be connected to each other to form the at least one leg hole.

The at least one leg hole may include a plurality of leg holes having different sizes.

The supporting device may be used to commonly support a washing machine and a drying machine with legs having different sizes.

In accordance with another aspect, a supporter includes a guide member installed on a supporting device to receive a leg connected to the bottom of a washing machine main body, and at least one fixing member hinged to the upper surface of the guide member to fix the leg, wherein the guide member includes at least one reception part to receive the leg of the washing machine main body, and the at least one fixing member includes at least one leg hole.

A plurality of fixing members may be provided, and the plurality of fixing members may be connected to each other to form the at least one leg hole.

The at least one leg hole may include a plurality of leg holes having different sizes.

The guide member may further include at least one protrusion formed on the outer circumferential surface of the at least one reception part of the guide member and connected with the at least one fixing member.

The guide member may further include a latching protrusion to restrict a rotating angle of the at least one fixing member.

The at least one fixing member may further include a connection groove connected with the at least one protrusion.

The at least one fixing member may further include a coupling part to couple the at least one fixing member to each other, and the coupling part may be provided with a coupling hole into which a coupling member is inserted.

In accordance with another aspect, a supporter includes a guide member installed on a supporting device to receive a leg connected to the bottom of a washing machine main body, and at least one fixing member slidably connected to the guide member to fix the leg, wherein the guide member includes at least one reception part to receive the leg of the washing machine main body, and the at least one fixing member includes at least one leg hole.

A plurality of fixing members may be provided, and the plurality of fixing members is connected to each other to form the at least one leg hole.

The at least one leg hole may include a plurality of leg holes having different sizes.

The at least one fixing member may further include connection parts to connect the guide member and the at least one fixing member.

The supporter may be used to commonly support a washing machine and a drying machine with legs having different sizes.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
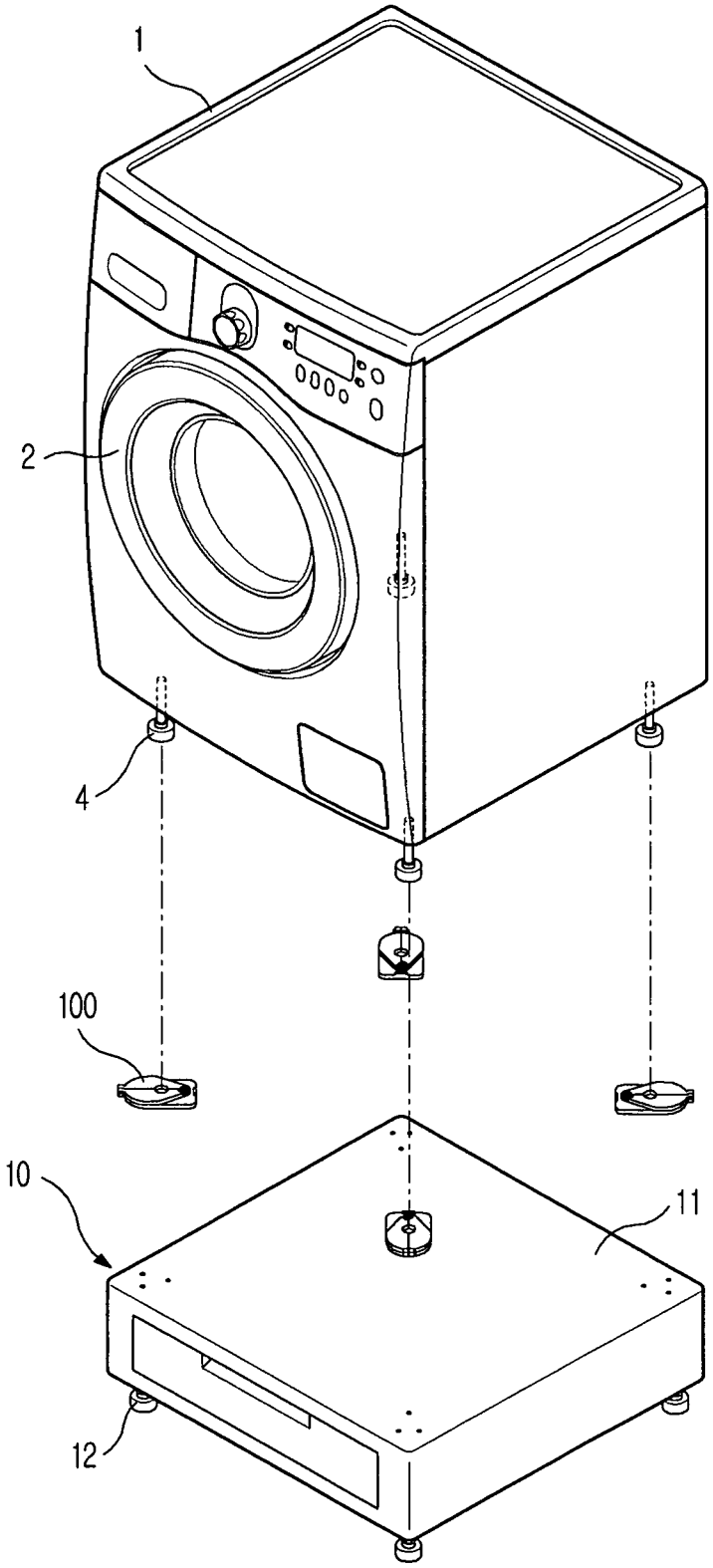
FIG. 1 is an exploded perspective view illustrating connection relations between a washing machine main body, a supporting device main body, and supporters in accordance with one embodiment.

Reference will now be made in detail to the embodiments, examples of which are illustrated in the accompanying drawings, wherein like reference numerals refer to like elements throughout.

FIG. 1 is an exploded perspective view illustrating connection relations between a washing machine main body 1, a supporting device main body 10, and supporters 100 in accordance with one embodiment.

As shown in FIG. 1, a washing machine in accordance with this embodiment includes the washing machine main body 1 provided with an opened front surface such that a user puts or takes laundry into and from the washing machine main body 1 through the opened front surface and forming an external appearance of the washing machine, a drum (not shown) installed within the washing machine main body 1 and rotated at a low or high speed by a driving motor (not shown) to wash and laundry the laundry, and a door 2 installed on the opened front surface of the washing machine main body 1. Legs 4 extended downwardly are connected to respective corners of the bottom of the washing machine main body 1.

The supporting device main body 10 to support the washing machine main body 1 at a designated height is formed in a box shape provided with an upper surface 11, a front surface, left and right surfaces, a bottom surface, and a rear surface.

The supporters 100 to receive and fix the legs 4 are connected to the supporting device main body 10, and supporting device legs 12 extended downwardly are connected to respective corners of the bottom surface of the supporting device main body 10.

Figure 2:
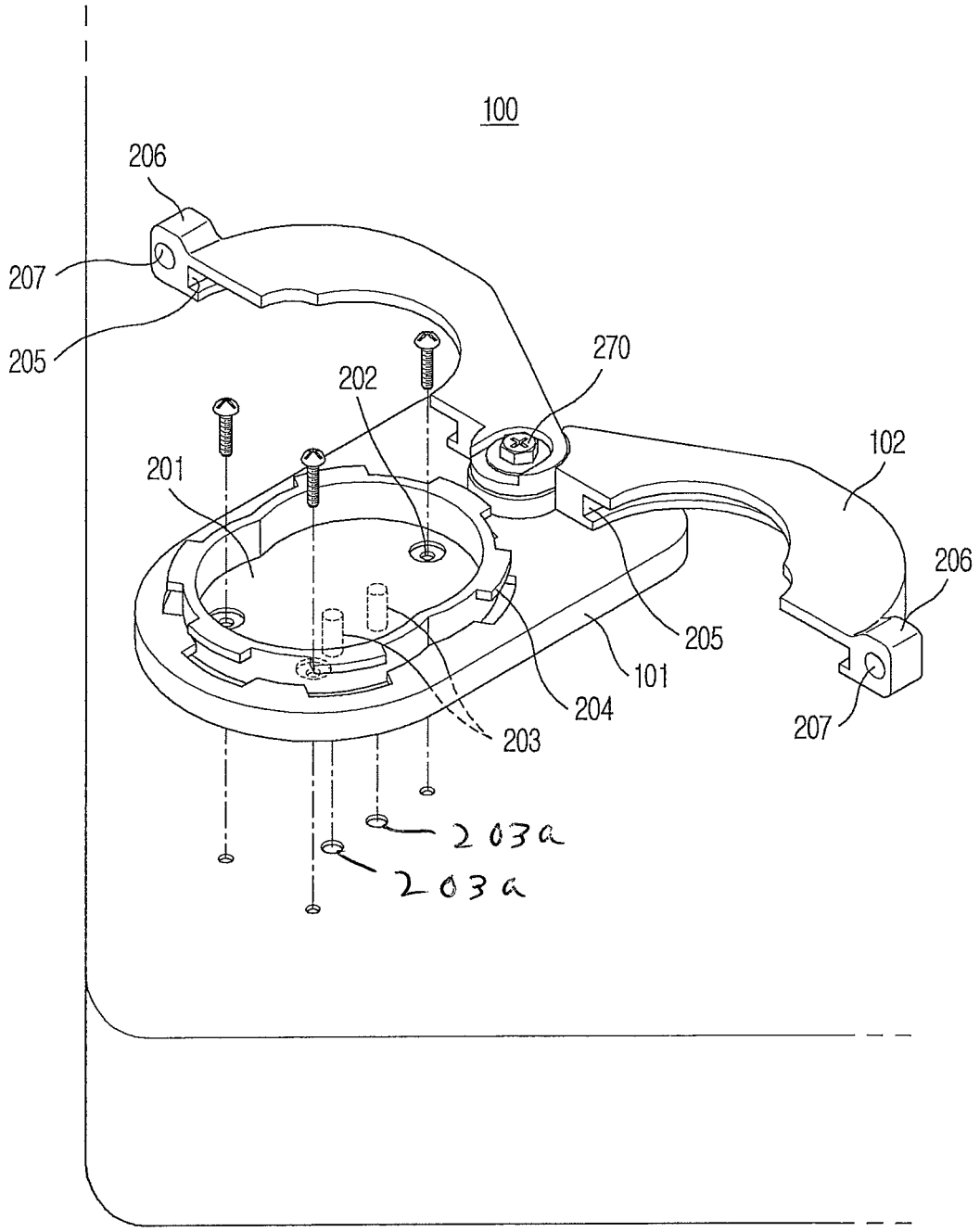
FIG. 2 is an enlarged perspective view illustrating connection relations between one corner of a supporting device main body and a supporter in accordance with a further embodiment.

FIG. 2 is an enlarged perspective view illustrating connection relations between one corner of a supporting device main body 10 and a supporter 100 in accordance with a further embodiment.

As shown in FIG. 2, the supporter 100 in accordance with this embodiment includes a guide member 101 to receive a leg 4 connected to a washing machine main body 1 to restrict movement of the leg 4 in the horizontal direction, and fixing members 102 to restrict movement of the leg 4 in the horizontal and vertical directions.

The guide member 101 includes at least one reception part 201 to receive the leg 4 of the washing machine main body 1. The reception part 201 is formed in a shape obtained by connecting two or more circles having the same diameter or different diameters. Since the leg 4 connected to the washing machine main body 1 is generally formed in a circular shape, this shape of the reception part 201 corresponds to the shape of the leg 4. Further, it is apparent that, although the leg 4 is not formed in a circular shape, the reception part 201 may be formed in a shape corresponding to the shape of the leg 4. The leg 4 connected to the washing machine main body 1 is seated in the reception part 201 of the guide member 101, and thereby movement of the leg 4 in the horizontal direction is restricted.

The guide member 101 further includes at least one connection hole 202 to connect the supporting device main body 10 and the supporter 100. In this embodiment, the connection hole 202 is formed through the reception part 201 of the guide member 101, and thus when the washing machine main body 1, the supporting device main body 10, and the supporter 100 is assembled, the connection hole 202 is hidden.

The guide member 101 further includes at least one protrusion 204 formed at the outer circumferential surface of the reception part 201 formed on the guide member 101 and connected with the fixing members 102. The protrusion 204 is connected to a connection groove 205, which will be described later, and serves to preliminarily fix the fixing members 102.

Figure 5A:
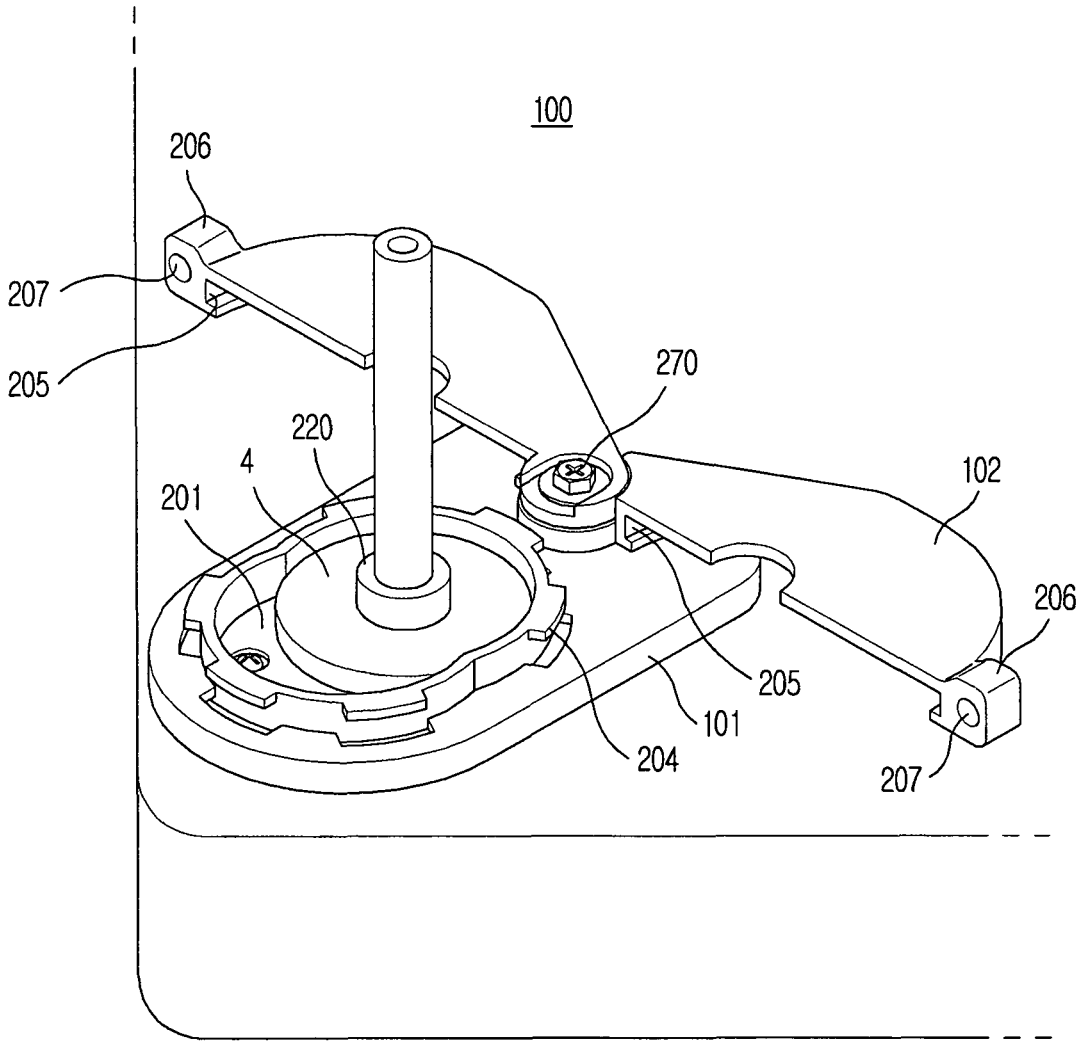
FIGS. 5A and 5B are perspective views illustrating a principle through which the supporter in accordance with the embodiment, as shown in FIG. 1, fixes a leg connected to the washing machine main body.
Figure 5B:
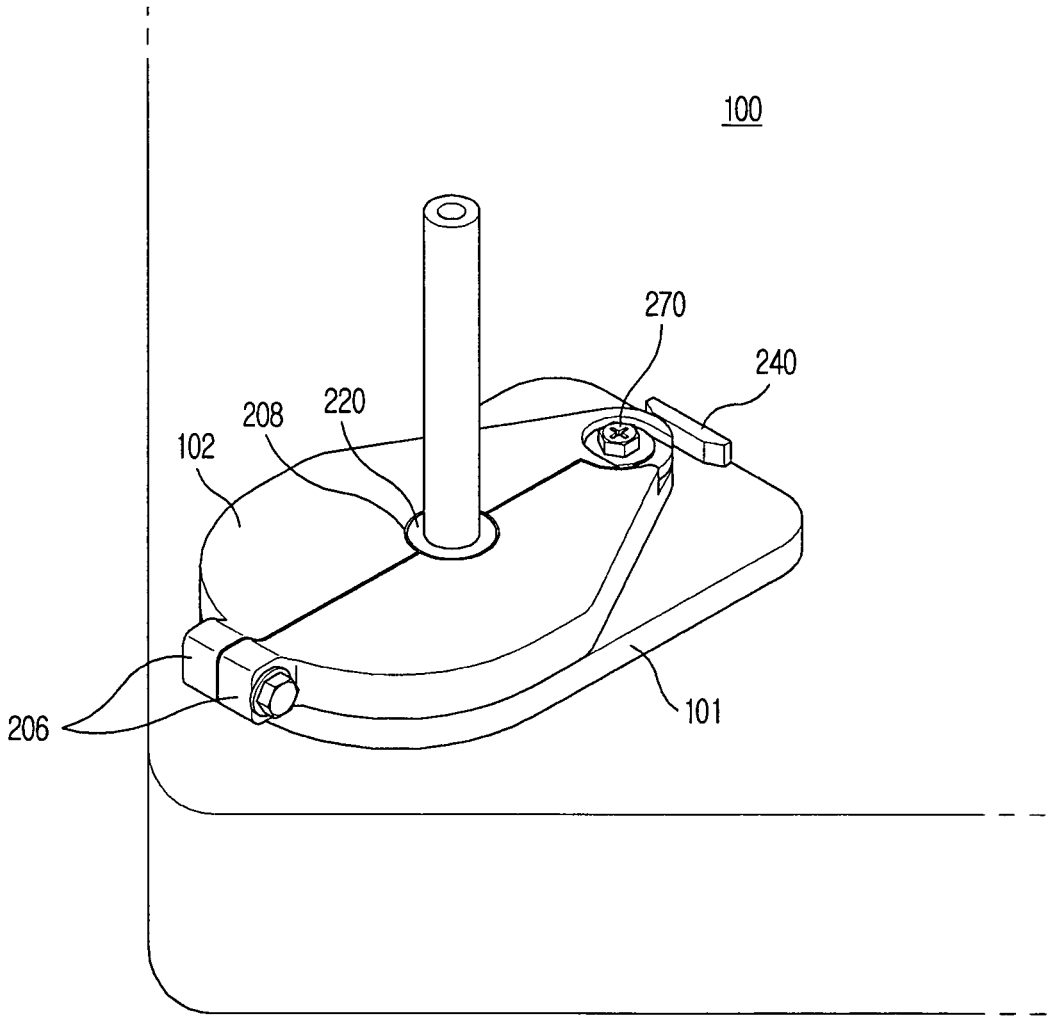

The guide member 101 further includes a latching protrusion 240 to prevent the fixing members 102 from being freely rotated around a hinge shaft 270 (with reference to FIG. 5B). By restricting a rotating angle of the fixing members 102 using the latching protrusion 240, interference of the fixing members 102 with other objects due to rotation of the fixing members 102 at an excessively large angle may be prevented.

The fixing members 102 are hinged to any one of the guide member 101 and the supporting device main body 10, and are rotated so as to be opened and closed.

Each of the fixing members 102 includes the connection groove 205 connected with the at least one protrusion 204 formed on the reception part 201 of the guide member 101. As described above, the connection groove 205 is connected with the protrusion 204 formed on the guide member 101, and thus serves to preliminarily fix the fixing member 102.

Each of the fixing members 102 includes a coupling part 206 to couple the fixing members 102 to each other. The coupling part 206 includes a coupling hole 207 at the central portion thereof, into which a coupling member to completely fix the fixing member 102 is inserted so as not to rotate the fixing member 102.

Figure 3:
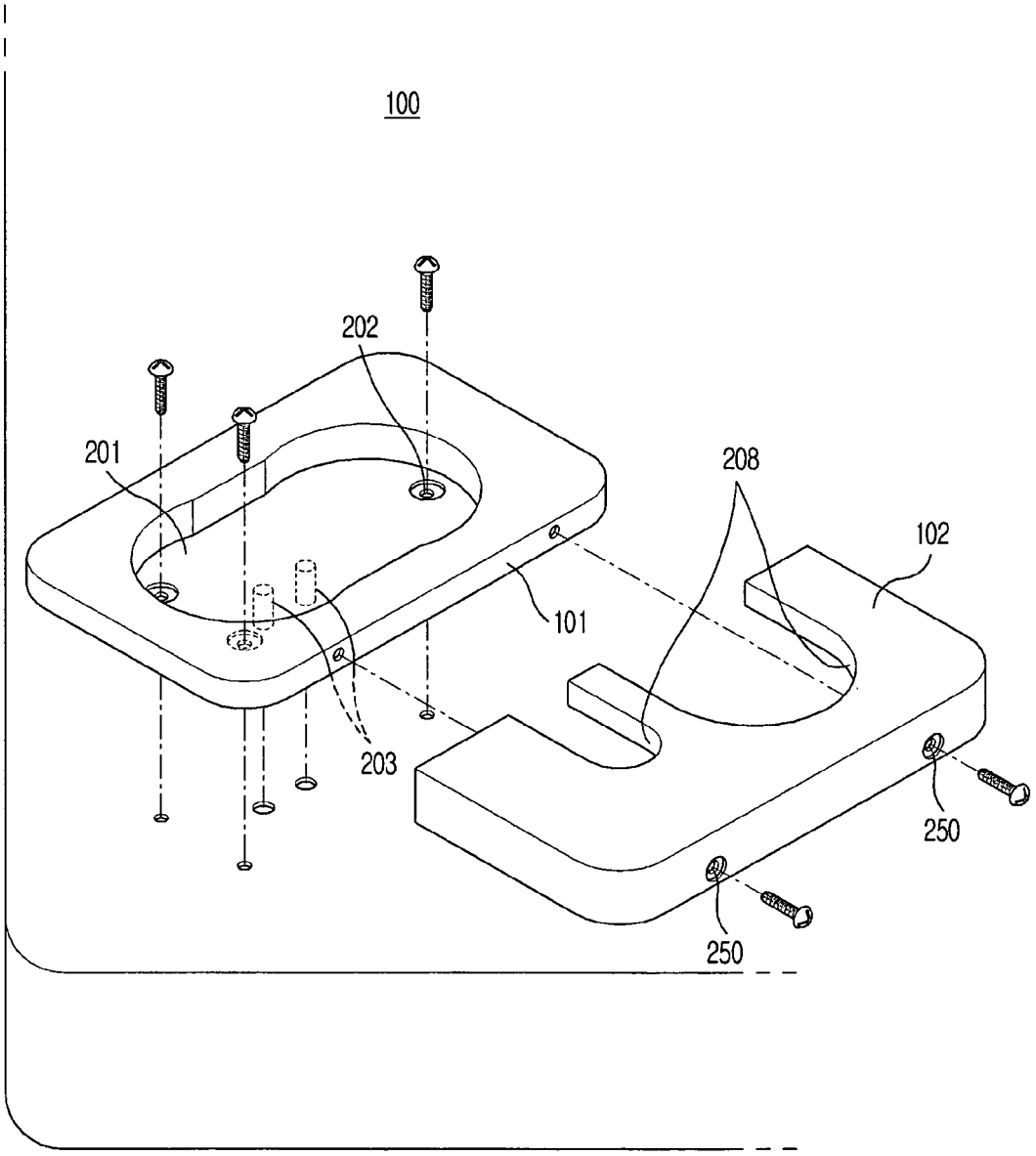
FIG. 3 is an enlarged perspective view illustrating connection relations between one corner of a supporting device main body and a supporter in accordance with another embodiment.

FIG. 3 is an enlarged perspective view illustrating connection relations between one corner of a supporting device main body 10 and a supporter 100 in accordance with another embodiment.

As shown in FIG. 3, the supporter 100 in accordance with this embodiment includes a guide member 101 to receive a leg 4 connected to a washing machine main body 1 to restrict movement of the leg 4 in the horizontal direction, and a fixing member 102 to restrict movement of the leg 4 in the horizontal and vertical directions.

The guide member 101 includes at least one reception part 201 to receive the leg 4 connected to the washing machine main body 1. The reception part 201 is formed in a shape obtained by connecting two or more circles having the same diameter or different diameters. Since the leg 4 connected to the washing machine main body 1 is generally formed in a circular shape, this shape of the reception part 201 corresponds to the shape of the leg 4. Further, it is apparent that, although the leg 4 is not formed in a circular shape, the reception part 201 may be formed in a shape corresponding to the shape of the leg 4. The leg 4 connected to the washing machine main body 1 is seated in the reception part 201 of the guide member 101, and thereby movement of the leg 4 in the horizontal direction is restricted.

The guide member 101 further includes at least one connection hole 202 to connect the supporting device main body 10 and the supporter 100. In this embodiment, the connection hole 202 is formed through the reception part 201 of the guide member 101, and thus when the washing machine main body 1, the supporting device main body 10, and the supporter 100 are assembled, the connection hole 202 is hidden.

The fixing member 102 is slidably connected to the guide member 101.

The fixing member 102 includes connection parts 250 to connect the guide member 101 and the fixing member 102 to each other.

Figure 4:
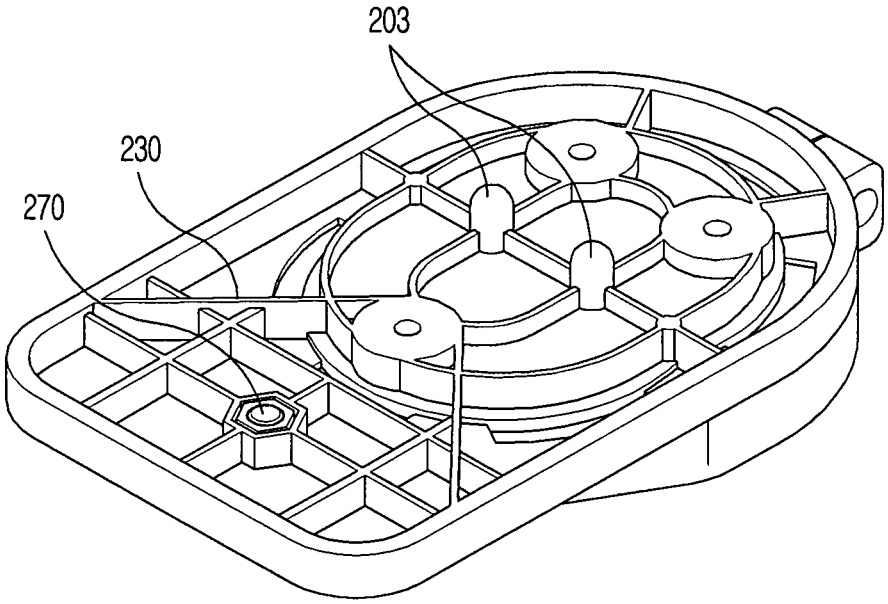
FIG. 4 is a bottom perspective view of each of the supporters in accordance with the embodiments.

FIG. 4 is a bottom perspective view of each of the supporters in accordance with the embodiments.

As shown in FIG. 4, the guide member 101 may further include position determination pins 203 provided on the bottom surface thereof to determine a position of the supporter 100 to be fixed in corresponding holes 203*a* on the upper surface 11 of the supporting device main body 10. Since the position of the supporter 100 to be fixed is set in advance using the position determination pins 203 provided on the bottom surface of the guide member 101 before the supporter 100 is completely fixed on the supporting device main body 10, the supporter 100 may be conveniently and rapidly fixed onto the supporting device main body 10.

A reinforcing rib 230 to reinforce the supporter 100 may be further formed on the bottom surface of the guide member 101. When the washing machine main body 1 is fixed to the supporting device main body 10 using the supporters 100 through a fixing method of the supporters 100, which will be described later, internal impact due to rotation of a motor of the washing machine or unexpected external impact may be applied to the washing machine main body 1. Here, a designated portion of the applied impact may be transmitted to the legs 4 connected to the washing machine main body 1, and then be transmitted to the supporters 100 fixing the legs 4. The reinforcing rib 230 formed on the bottom surface of the guide member 101 prevents the supporters 100 from being damaged due to such impact.

FIGS. 5A and 5B, FIGS. 6A and 6B, and FIGS. 7A and 7B are perspective views respectively illustrating a principle through which the supporter 100 in accordance with each embodiment fixes the leg 4 connected to the washing machine main body 100.

As shown in FIGS. 5A and 5B, the supporter 100 in accordance with the embodiment, as shown in FIG. 1, includes the guide member 101 and the fixing members 102. The fixing members 102 are preliminarily connected to the guide member 101 by inserting the at least one protrusion 204 formed on the reception part 201 of the guide member 101 into the connection groove 205 formed in each fixing member 102, and are fixed to each other by the coupling member inserted into the coupling holes 207 formed on the coupling parts 206, thereby forming a leg hole 208.

Figure 6A:
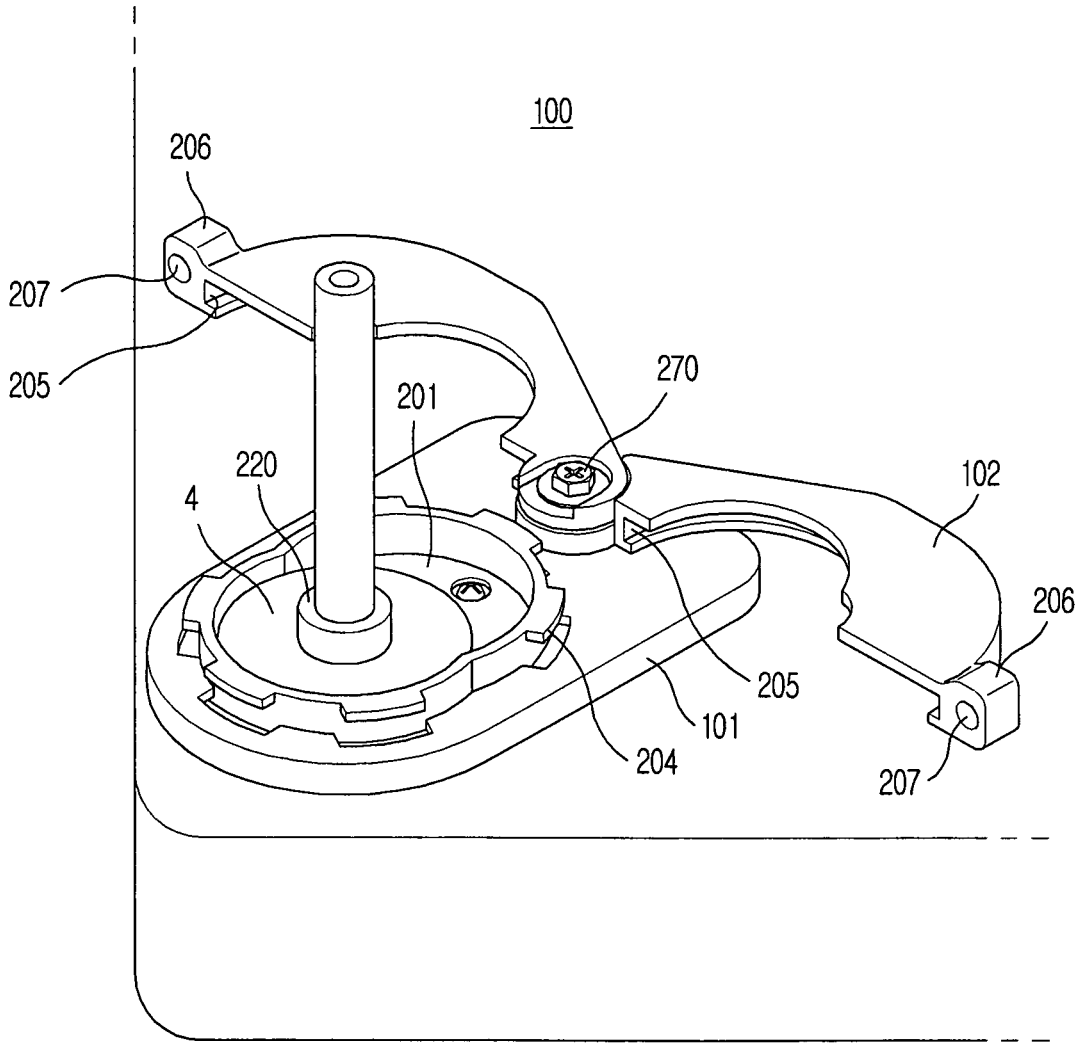
FIGS. 6A and 6B are perspective views illustrating a principle through which the supporter in accordance with the embodiment, as shown in FIG. 2, fixes a leg connected to the washing machine main body.
Figure 6B:
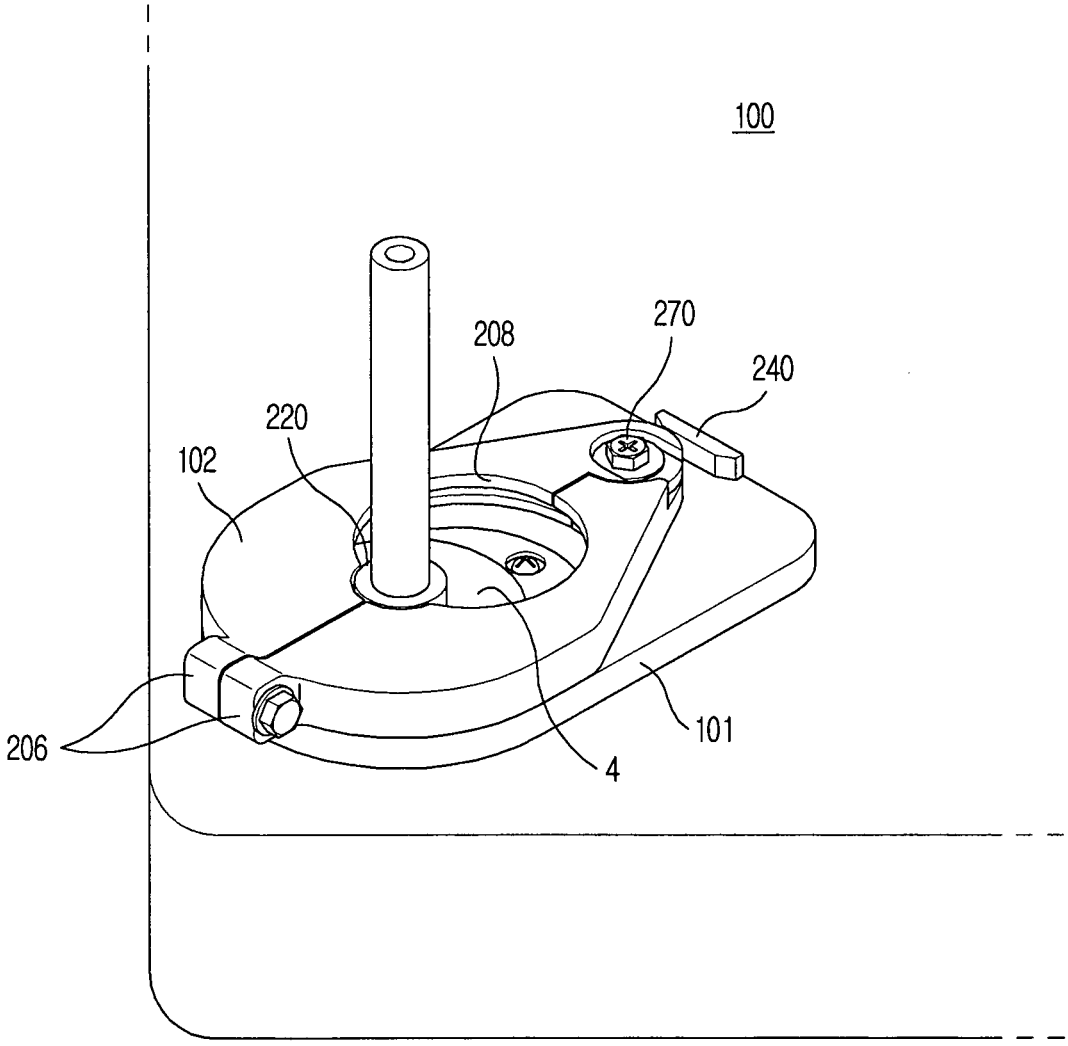

As shown in FIGS. 6A and 6B, the supporter 100 in accordance with the embodiment, as shown in FIG. 2, includes the guide member 101 and the fixing members 102. The fixing members 102 are preliminarily connected to the guide member 101 by inserting the at least one protrusion 204 formed on the reception part 201 of the guide member 101 into the connection groove 205 formed in each fixing member 102, and are fixed to each other by the coupling member inserted into the coupling holes 207 formed on the coupling parts 206, thereby forming a leg hole 208 having a shape in which two or more circles are connected.

Figure 7A:
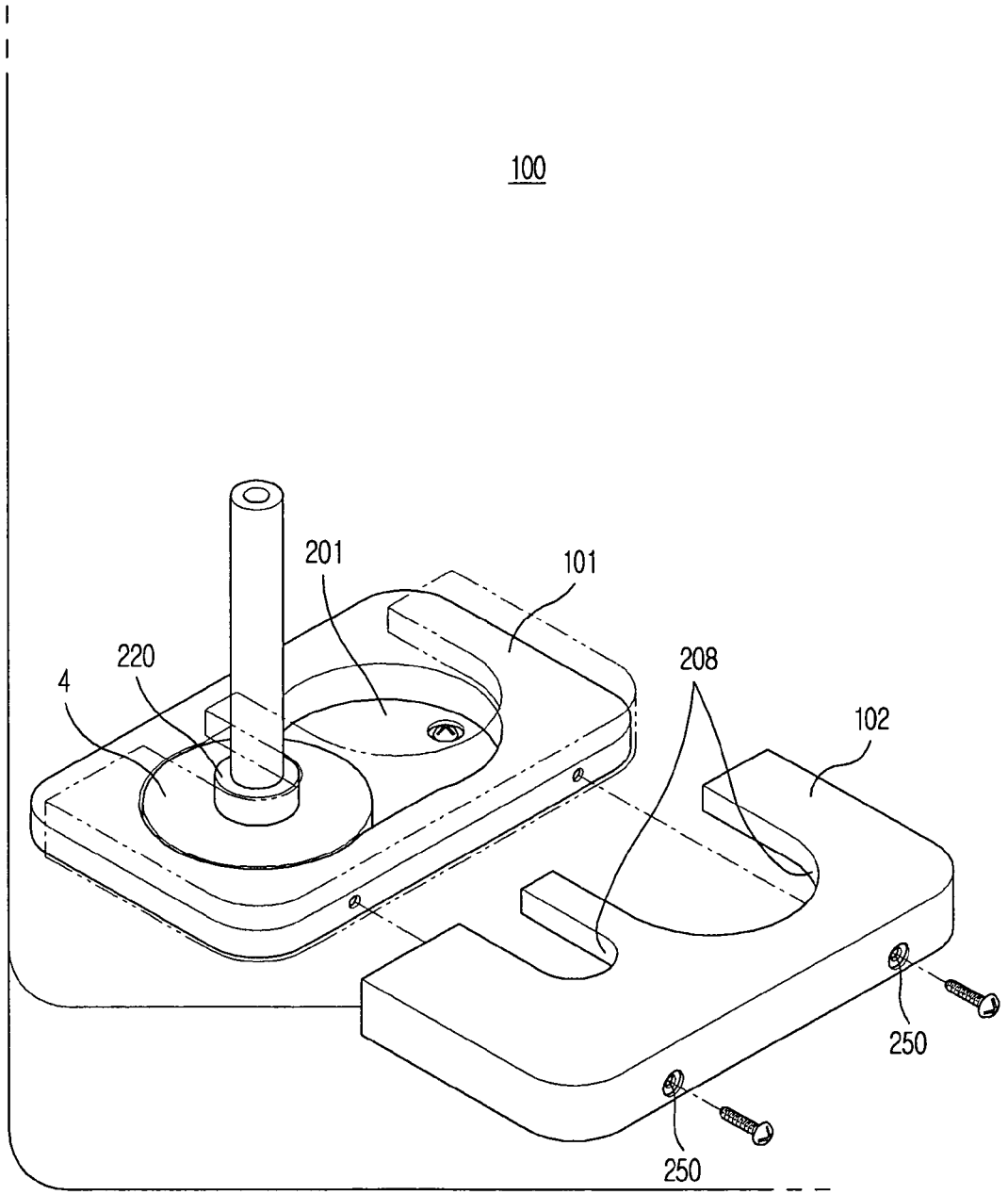
FIGS. 7A and 7B are perspective views respectively illustrating a principle through which the supporter in accordance with the embodiment, as shown in FIG. 3, fixes a leg connected to the washing machine main body, and a principle through which a supporter in accordance with another embodiment fixes a leg connected to the washing machine main body.

As shown in FIG. 7A, the supporter 100 in accordance with the embodiment, as shown in FIG. 3, includes the guide member 101 and the fixing member 102. At least one leg hole 208 to fix a leg connection part 220 is formed through the fixing member 102.

Figure 7B:
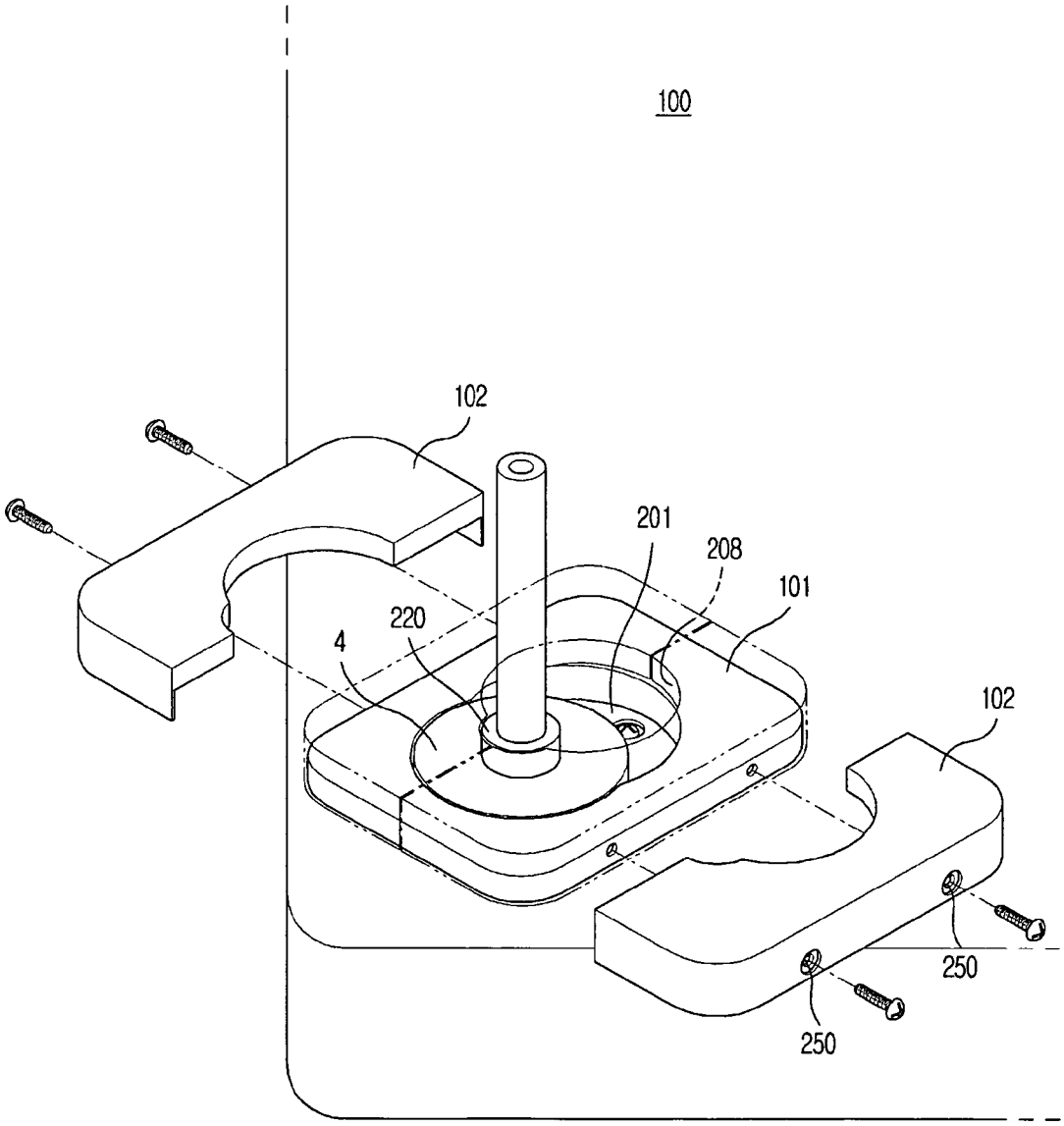

As shown in FIG. 7B, a supporter 100 in accordance with another embodiment includes a guide member 101 and fixing members 102. The fixing members 102 are fixed to the guide member 101 by connection parts 250, thereby forming a leg hole 208.

The leg holes 208 of the supporters 100, as shown in FIGS. 5A and 5B, FIGS. 6A and 6B, and FIG. 7B are formed in a circular shape or a shape in which two or more circles are connected, and the leg hole 208 of the supporter 100, as shown in FIG. 7A, is formed in a shape in which one side is opened. These shapes of the leg holes 208 are formed so as to correspond to the general shape, i.e., the circular shape of the leg 4 connected to the washing machine main body 1 or the leg connection part 220. Further, it is apparent that, although the leg 4 or the leg connection part 220 is not formed in a circular shape, the leg hole 208 may be formed in a shape corresponding to the shape of the leg 4 or the leg connection part 220.

The size of the leg holes 208 formed in accordance with the above embodiments is smaller than the size of the legs 4 connected to the bottom surface of the washing machine main body 1, and thus the leg holes 208 restrict movement of the legs 4 in the vertical direction. Further, the leg holes 208 fix the leg connection parts 220 to connect the washing machine main body 1 and the legs 4, and thus restrict movement of the legs 4 in the horizontal direction.

Hereinafter, a principle through which the washing machine main body 1 is connected and fixed to the supporting device main body 10 using the supporters 100 in accordance with the embodiments of the present invention, as shown in FIGS. 5A and 5B and FIGS. 6A and 6B, will be described.

First, the supporters 100 are located on the supporting device main body 10 using the position determination pins 203 formed on the bottom surfaces of the guide members 101. Here, one supporter 100 may be located at each of respective corners of the upper surface 11 of the supporting device main body 10. Thereafter, the supporters 100 are completely fixed to the supporting device main body 10 using the at least one connection hole 202 formed on the reception part 201 of each of the guide members 101. Finally, the fixing members 102 hinged to the guide members 102 or the supporting device main body 10 are rotated around the hinge shaft 270 so as to be opened, and the legs 4 connected to the bottom surface of the washing machine main body 1 are not separated from the washing machine main body 1 but are directly seated in the reception parts 201 of the guide members 101. Thereafter, the opened fixing members 102 are closed, and the coupling members are inserted into the coupling holes 207 formed on the coupling parts 206 of the fixing members 102, thereby fixing the washing machine main body 1 to the supporting device main body 10.

A principle through which the washing machine main body 1 is connected and fixed to the supporting device main body 10 using the supporters 100 in accordance with the embodiments of the present invention, as shown in FIGS. 7A and 7B, is equal to the principle in accordance with the above embodiments of the present invention, except that the fixing members 102 are slidably connected to the guide members 101 and the coupling members are inserted into the connection parts 250 of the fixing members 101 so as to fix the washing machine main body 1 to the supporting device main body 10, instead of the opening and closing of the fixing members 102 hinged to the guide members 101 or the supporting device main body 10 around the hinge shaft 270.

The reception parts 201 of the guide members 101 directly receive the legs 4 connected to the bottom surface of the washing machine main body 1 to restrict movement of the washing machine main body 1 in the horizontal direction, and the fixing members 102 connected to the guide members 101 are fixed by the coupling members inserted into the coupling holes 207 of the coupling parts 206 or the coupling members inserted into the connection parts 250 to restrict movement of the washing machine main body 1 in the horizontal and vertical directions, which may be generated when external impact is applied to the washing machine main body 1. Therefore, the guide members 101 and the fixing members 102 of the supporters 100 completely restrict movement of the washing machine main body 1, thereby completing fixing the washing machine main body 1.

Since the washing machine main body 1 is directly seated on the supporters 100 connected to the upper surface of the supporting device main body 10, as described above, a process of removing the legs 4 from the bottom of the washing machine main body 1, a process of laying the washing machine main body 1 by means of two or more workers to remove the legs 4 from the bottom of the washing machine main body 1, and a process of disassembling the front and rear surfaces of the supporting device main body 10 to put assembly tools into the supporting device main body 10 may be omitted. Further, since erection of the assembly tools within the supporting device main body 10 is not required, increase of the height of the supporting device main body 10 to be higher than those of the assembly tools is not required. Therefore, the number of workers required during the assembly process may be reduced and an assembly time may be greatly shortened.

Figure 8A:
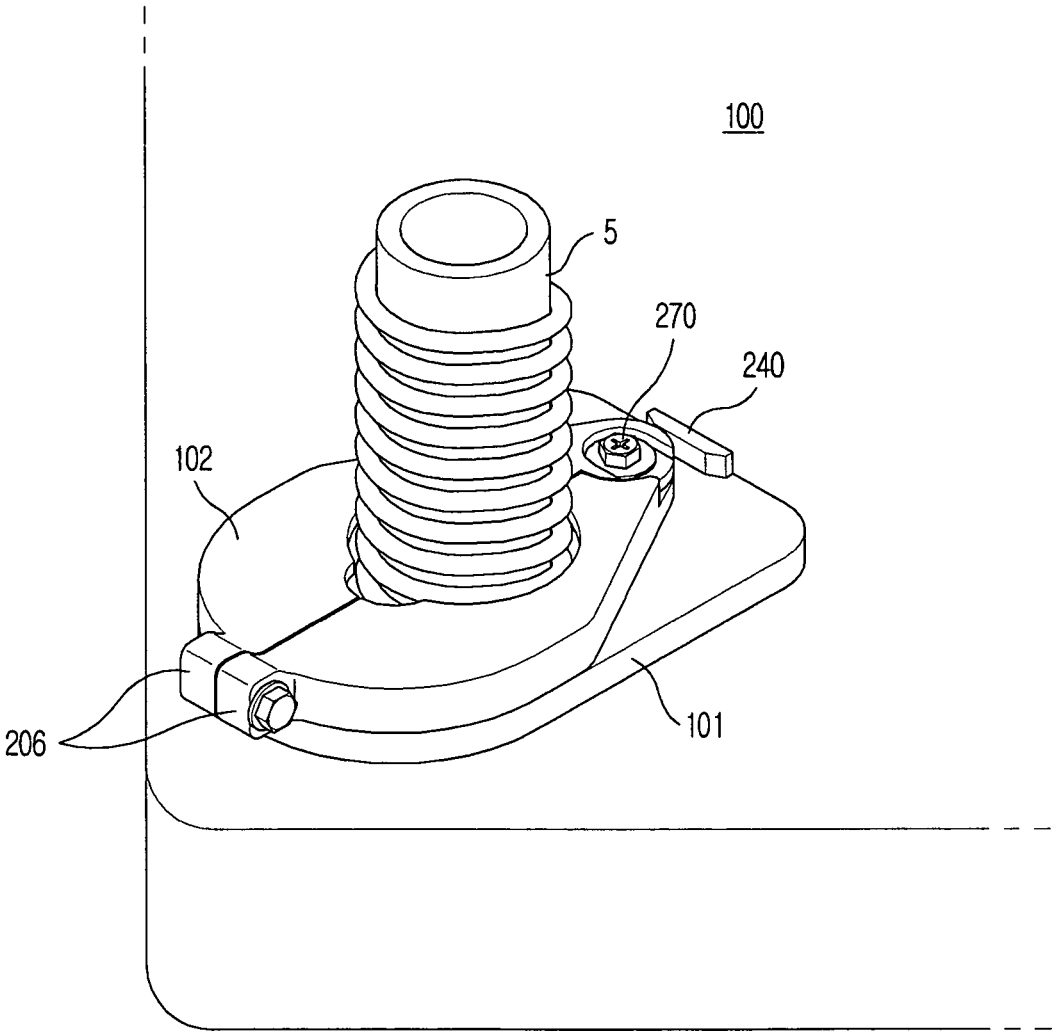
FIGS. 8A and 8B are perspective views illustrating use of the supporter in accordance with the embodiment, as shown in FIGS. 6A and 6B, in common in a washing machine and a drying machine with legs having different sizes.
Figure 8B:
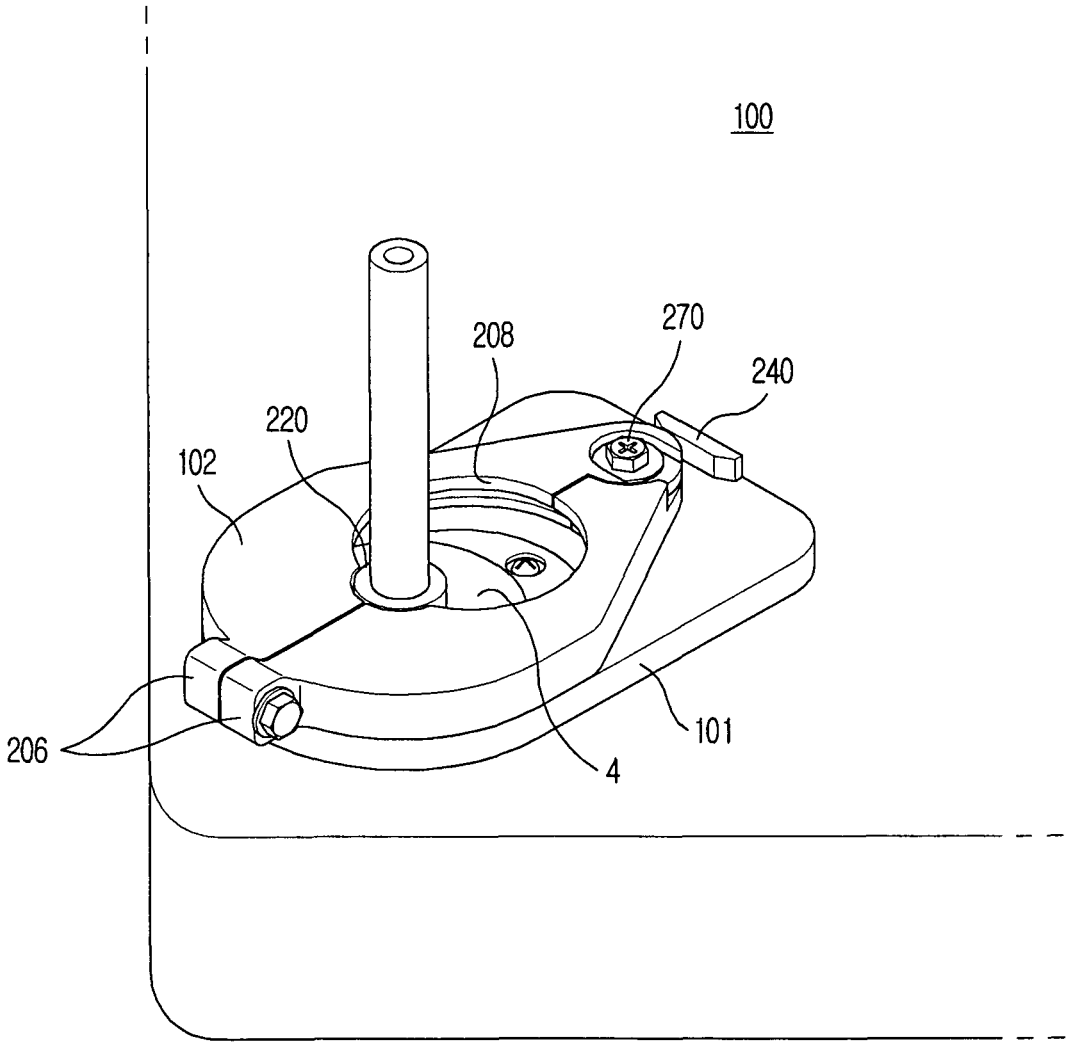

FIGS. 8A and 8B are perspective views illustrating use of the supporter in accordance with the embodiment, as shown in FIGS. 6A and 6B, in common in a washing machine and a drying machine with legs having different sizes.

As shown in FIGS. 8A and 8B, among two or more circular parts connected to each other to form one leg hole 208, one circular part has a size corresponding to a size of a leg 5 of the drying machine, and the other circular part has a size corresponding to a size of a leg 4 of the washing machine. Thereby, the supporter 100 to support the washing machine and drying machine with legs having different sizes in common, and the supporting device main body 10 having the same may be manufactured.

The leg hole 208 formed by the fixing members 102 of the supporter 100 may be manufactured according to shapes or sizes of the legs of the washing machine and the drying machine to be supported in common.

FIGS. 8A and 8B illustrate that the fixing members 102 of the supporter 100 are hinged to one of the guide member 101 and the supporting device main body 10. However, even if the fixing member(s) 102 of the supporter 100 is/are slidably connected to the guide member 101, as shown in FIGS. 7A and 7B, the supporter 100 to support the washing machine and drying machine with legs having different sizes in common and the supporting device main body 10 having the same may be manufactured.

Further, although the above embodiments illustrate that the supporter 100 and the supporting device main body 10 having the same are used to support the washing machine and the drying machine with legs having different sizes in common, the supporter 100 and the supporting device main body 10 having the same may be applied to other general products with legs.

Moreover, the supporter 100 may be generally manufactured through injection molding, and any material which has a designated strength so as not to be easily broken by impact, such as a Poly Oxy Methylene (POM) may be used to manufacture the supporter 100 through injection molding.

As is apparent from the above description, in accordance with embodiments of the present invention, a washing machine main body is directly seated on a supporting device using supporters, thus improving assembly efficiency.

Further, the supporting device supports a washing machine and a drying machine with legs having different sizes in common using the supporters.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a washing machine main body;

a supporting device main body to support the washing machine main body;

a plurality of legs connected to a bottom of the washing machine main body; and supporters installed on the supporting device main body, and each supporter includes a guide member to receive each leg and a pair of fixing members to fix each leg;

wherein the guide member has at least one fixing part to fix the supporter on the supporting device main body and at least one reception part to receive each leg, and wherein the pair of fixing members are rotatably coupled on an upper surface of the guide member, and coupled to each other to form a leg opening;

wherein the at least one reception part includes a first reception hole and a second reception hole overlapping with the first reception hole, wherein the leg opening includes a first leg hole and a second leg hole overlapping with the first leg hole, the second leg hole having a radius smaller than a radius of the first leg hole, and wherein the first leg hole supports an outer circumferential surface of the leg when the leg is received in the first reception hole and the second leg hole supports an outer circumferential surface of the leg when the leg is received in the second reception hole;

wherein the at least one reception part extends from the upper surface of the guide member in a first direction, wherein the guide member includes at least one protrusion extending from the at least one reception part in a second direction different from the first direction, and the pair of fixing members includes at least one connection groove engaged with the at least one protrusion.

2. The washing machine according to claim 1, wherein the at least one fixing part includes at least one connection hole and a corresponding fastener therein to connect the supporting device main body and the supporter.

3. The washing machine according to claim 1, wherein the guide member further includes a plurality of position determination pins provided on a bottom surface of the guide member, and the supporting device main body includes a corresponding plurality of holes to receive the plurality of pins, to fix each of the supporters on the supporting device main body.

4. The washing machine according to claim 1, wherein the guide member further includes a rib provided on a bottom surface of the guide member to reinforce the supporter.

5. A supporting device comprising:

a supporting device main body to support a washing machine main body; and supporters installed on the supporting device main body to receive and fix legs connected to a bottom of the washing machine main body, and each supporter includes a guide member to receive each leg and a pair of fixing members to fix each leg;

wherein the guide member has at least one fixing part to fix the supporter on the supporting device main body and at least one reception part to receive each leg, and wherein the pair of fixing members are rotatably coupled on an upper surface of the guide member, and coupled to each other to form a leg opening;

wherein the at least one reception part includes a first reception hole and a second reception hole overlapping with the first reception hole, wherein the leg opening includes a first leg hole and a second leg hole overlapping with the first leg hole, the second leg hole having a radius smaller than a radius of the first leg hole, and wherein the first leg hole supports an outer circumferential surface of the leg when the leg is received in the first reception hole and the second leg hole supports an outer circumferential surface of the leg when the leg is received in the second reception hole;

wherein the at least one reception part extends from the upper surface of the guide member in a first direction, wherein the guide member includes at least one protrusion extending from the at least one reception part in a second direction different from the first direction, and the pair of fixing members includes at least one connection groove engaged with the at least one protrusion.

6. The supporting device according to claim 5, wherein the supporting device main body is used to commonly support a washing machine and a drying machine with legs having different sizes.

7. A supporter comprising:

a guide member installed on a supporting device to receive a leg connected to a bottom of a washing machine main body; and a pair of fixing members hinged to an upper surface of the guide member to fix the leg, wherein the guide member includes at least one fixing part to fix the guide member on the supporting device and at least one reception part to receive the leg of the washing machine main body, and the pair of fixing members are rotatably coupled on an upper surface of the guide member, and coupled to each other to form a leg opening;

wherein the at least one reception part includes a first reception hole and a second reception hole overlapping with the first reception hole, wherein the leg opening includes a first leg hole and a second leg hole overlapping with the first leg hole, the second leg hole having a radius smaller than a radius of the first leg hole, and wherein the first leg hole supports an outer circumferential surface of the leg when the leg is received in the first reception hole and the second leg hole supports an outer circumferential surface of the leg when the leg is received in the second reception hole;

wherein the at least one reception part extends from the upper surface of the guide member in a first direction, wherein the guide member includes at least one protrusion extending from the at least one reception part in a second direction different from the first direction, and the pair of fixing members includes at least one connection groove engaged with the at least one protrusion.

8. The supporter according to claim 7, wherein the at least one protrusion is formed on an outer circumferential surface of the at least one reception part.

9. The supporter according to claim 7, wherein the guide member further includes a latching protrusion to restrict a rotating angle of the fixing members.

10. The supporter according to claim 7, wherein the fixing members further include a coupling part to couple the pair of fixing members to each other, and the coupling part is provided with a coupling hole into which a coupling member is inserted.

11. The supporter according to claim 7, wherein the supporter is used to commonly support a washing machine and a drying machine with legs having different sizes.

* * * * *